US011559099B2

(12) United States Patent
Bartels et al.

(10) Patent No.: US 11,559,099 B2
(45) Date of Patent: Jan. 24, 2023

(54) PROTECTIVE HELMET

(71) Applicant: Schuberth GmbH, Magdeburg (DE)

(72) Inventors: Sven Bartels, Genthin (DE); Tobias Welle, Magdeburg (DE)

(73) Assignee: SCHUBERTH GMBH

( * ) Notice: Subject to any disclaimer, the term of this patent is extended or adjusted under 35 U.S.C. 154(b) by 0 days.

(21) Appl. No.: 17/059,896

(22) PCT Filed: May 28, 2019

(86) PCT No.: PCT/EP2019/063825
§ 371 (c)(1),
(2) Date: Nov. 30, 2020

(87) PCT Pub. No.: WO2019/229065
PCT Pub. Date: Dec. 5, 2019

(65) Prior Publication Data

US 2021/0186138 A1 Jun. 24, 2021
US 2022/0295932 A9 Sep. 22, 2022

(30) Foreign Application Priority Data

May 30, 2018 (DE) ..... 10 2018 004 314.3

(51) Int. Cl.
*A42B 3/04* (2006.01)

(52) U.S. Cl.
CPC ..... *A42B 3/044* (2013.01)

(58) Field of Classification Search
CPC ..... A42B 3/044
See application file for complete search history.

(56) References Cited

U.S. PATENT DOCUMENTS 3,422,224 A 1/1969 Curran
3,470,558 A 9/1969 Raschke
(Continued)

FOREIGN PATENT DOCUMENTS

CN 1627651 A 6/2005
CN 1715734 A 1/2006
(Continued)

OTHER PUBLICATIONS

Wikipedia, Wireless Personal Area Network, https://de.wikipedia.org/w/index.php?title=Wireless_Personal_Area_Network, printed Mar. 27, 2018, 4 pages.
(Continued)

*Primary Examiner* — Thomas M Sember
(74) *Attorney, Agent, or Firm* — McCarter & English, LLP

(57) ABSTRACT

A protective helmet, particularly a motorbike protective helmet, comprising an outer shell (1) for the distribution of impact forces, the outer shell (1) comprising a chin shell region (2) for covering a chin part of the person wearing the protective helmet, wherein the outer shell (1) comprises a viewing opening (3) arranged above the chin shell region (2), for the person wearing the protective helmet to see through, and the protective helmet has a slot (4*a*) with a slot shape for interlockingly receiving an electronic module (5*a*) corresponding to the slot shape, said slot (4*a*) comprising a slot opening substantially bordering an edge of the viewing opening (3). The protective helmet comprises another slot (4*b*) having another slot opening substantially bordering the edge of the viewing opening (3) and having the slot shape for interlockingly receiving another electronic module (5*b*) corresponding to the slot shape.

22 Claims, 3 Drawing Sheets

(56) References Cited

U.S. PATENT DOCUMENTS

| | | | |
|---|---|---|---|
| 3,582,951 | A | 6/1971 | Altmayer |
| 3,885,246 | A | 5/1975 | Tung |
| 3,963,917 | A | 6/1976 | Romano |
| 3,977,003 | A | 8/1976 | Kershaw |
| 4,077,007 | A | 2/1978 | McKinney |
| 4,109,105 | A | 8/1978 | Von Statten, Jr. |
| 4,130,803 | A | 12/1978 | Thompson |
| 4,152,553 | A | 5/1979 | White |
| 4,178,411 | A | 12/1979 | Cole et al. |
| 4,239,106 | A | 12/1980 | Aileo |
| 4,321,433 | A | 3/1982 | King |
| 4,357,711 | A | 11/1982 | Drefko et al. |
| 4,400,591 | A | 8/1983 | Jennings et al. |
| 4,466,138 | A | 8/1984 | Gessalin |
| 4,519,099 | A | 5/1985 | Kamiya et al. |
| 4,563,392 | A | 1/1986 | Harpell et al. |
| 4,719,462 | A | 1/1988 | Hawkins |
| 4,729,132 | A | 3/1988 | Fierro |
| 4,833,726 | A | 5/1989 | Shinoda et al. |
| 4,903,350 | A | 2/1990 | Gentes et al. |
| 4,950,439 | A | 8/1990 | Smith et al. |
| 5,119,505 | A | 6/1992 | Tisseront et al. |
| 5,136,567 | A | 8/1992 | Nagahara et al. |
| 5,136,657 | A | 8/1992 | Hattori |
| 5,142,700 | A | 8/1992 | Reed |
| 5,183,701 | A | 2/1993 | Jacobs et al. |
| 5,291,203 | A | 3/1994 | Schneck |
| 5,327,588 | A | 7/1994 | Garneau |
| 5,329,637 | A | 7/1994 | Walker |
| 5,357,409 | A | 10/1994 | Glatt |
| 5,438,702 | A | 8/1995 | Jackson |
| 5,448,780 | A | 9/1995 | Gath |
| 5,508,900 | A | 4/1996 | Norman |
| 5,615,410 | A | 3/1997 | DeMars |
| 5,683,831 | A | 11/1997 | Baril et al. |
| 5,718,004 | A | 2/1998 | Broersma et al. |
| 5,743,621 | A | 4/1998 | Mantha et al. |
| 5,749,096 | A | 5/1998 | Fergason et al. |
| 5,862,528 | A | 1/1999 | Saijo et al. |
| 5,886,667 | A | 3/1999 | Bondyopadhayay |
| 5,931,559 | A | 8/1999 | Pfaeffle |
| 5,996,128 | A | 12/1999 | Yanagihara |
| 6,009,563 | A | 1/2000 | Swanson et al. |
| 6,081,929 | A | 7/2000 | Rothrock et al. |
| 6,336,220 | B1 | 1/2002 | Sacks et al. |
| 6,464,369 | B1 | 10/2002 | Vega et al. |
| 6,691,325 | B1 | 2/2004 | Pelletier et al. |
| 6,701,537 | B1 | 3/2004 | Stamp |
| 7,377,666 | B1 | 5/2008 | Tyler |
| 7,532,163 | B2 | 5/2009 | Chang et al. |
| 7,555,312 | B2 | 6/2009 | Kim et al. |
| 7,555,788 | B2 | 7/2009 | Schimpf |
| 7,901,104 | B2 | 3/2011 | McLean et al. |
| 8,001,623 | B2 | 8/2011 | Gertsch et al. |
| 8,009,229 | B1 | 8/2011 | Peterson |
| 8,245,326 | B1 | 8/2012 | Tolve |
| 8,544,399 | B2 | 10/2013 | Miloslavsky |
| 8,545,959 | B2 | 10/2013 | McGuire, Jr. et al. |
| 8,667,617 | B2 | 3/2014 | Glezerman et al. |
| 8,853,105 | B2 | 10/2014 | Bhatnagar et al. |
| 8,908,389 | B2 | 12/2014 | Teetzel et al. |
| 9,070,978 | B2 | 6/2015 | Boni et al. |
| 9,247,779 | B1 | 2/2016 | Aloumanis et al. |
| 9,445,639 | B1 | 9/2016 | Aloumanis et al. |
| 9,456,649 | B2 | 10/2016 | Basson |
| 9,486,027 | B2 | 11/2016 | Dey et al. |
| 9,585,433 | B1 | 3/2017 | Heimer et al. |
| 9,686,136 | B1 | 6/2017 | Dey et al. |
| 9,711,146 | B1 | 7/2017 | Cronin |
| 9,833,933 | B2 | 12/2017 | Cadens Ballarin |
| 9,968,153 | B2 | 5/2018 | Thompson et al. |
| 10,051,908 | B2 | 8/2018 | Redpath et al. |
| 10,160,156 | B2 | 12/2018 | Pourboghrat et al. |
| 10,219,571 | B1 | 3/2019 | Aloumanis et al. |
| 10,383,384 | B2 | 8/2019 | Zhavoronkov et al. |
| 10,779,604 | B2 | 9/2020 | Lebel et al. |
| 10,806,204 | B2 | 10/2020 | Pritz |
| 10,814,524 | B2 | 10/2020 | Prins et al. |
| 10,856,599 | B1 | 12/2020 | Cuenca |
| 11,278,076 | B2 | 3/2022 | Suddaby |
| 2005/0017911 | A1 | 1/2005 | Lee |
| 2006/0232955 | A1 | 10/2006 | Labine |
| 2006/0277664 | A1 | 12/2006 | Akhtar et al. |
| 2006/0277666 | A1* | 12/2006 | Gertsch ..... A42B 3/044 2/424 |
| 2007/0220662 | A1 | 9/2007 | Pierce |
| 2007/0289044 | A1 | 12/2007 | Ellis |
| 2008/0068825 | A1 | 3/2008 | Harris |
| 2008/0130271 | A1 | 6/2008 | Harris |
| 2009/0064386 | A1 | 3/2009 | Rogers |
| 2009/0158508 | A1 | 6/2009 | Quaranta et al. |
| 2009/0199317 | A1 | 8/2009 | Schwiers et al. |
| 2010/0175172 | A1 | 7/2010 | Dempsey et al. |
| 2010/0287687 | A1 | 11/2010 | Ho |
| 2011/0302701 | A1 | 12/2011 | Kuo |
| 2012/0011631 | A1 | 1/2012 | Crossman et al. |
| 2012/0077438 | A1 | 3/2012 | Jung |
| 2012/0189153 | A1 | 7/2012 | Kushnirov et al. |
| 2012/0272435 | A1 | 11/2012 | Glezerman et al. |
| 2013/0007949 | A1 | 1/2013 | Kurs et al. |
| 2013/0081199 | A1 | 4/2013 | Nimura |
| 2013/0176183 | A1 | 7/2013 | Boni et al. |
| 2013/0190052 | A1 | 7/2013 | Lundell |
| 2013/0305437 | A1 | 11/2013 | Weller et al. |
| 2014/0000013 | A1 | 1/2014 | Redpath et al. |
| 2014/0000014 | A1 | 1/2014 | Redpath et al. |
| 2014/0020159 | A1 | 1/2014 | Teetzel et al. |
| 2014/0109297 | A1 | 4/2014 | Lanez |
| 2014/0189938 | A1 | 7/2014 | Redpath et al. |
| 2014/0362244 | A1 | 12/2014 | Martin |
| 2015/0038199 | A1 | 2/2015 | Shirashi |
| 2015/0223547 | A1 | 8/2015 | Wibby |
| 2015/0282549 | A1 | 10/2015 | Lebel et al. |
| 2016/0100649 | A1 | 4/2016 | Glezerman et al. |
| 2016/0106174 | A1 | 4/2016 | Chung et al. |
| 2016/0249700 | A1 | 9/2016 | Zhavoronkov et al. |
| 2017/0006955 | A1 | 1/2017 | Dow, II et al. |
| 2017/0052000 | A1 | 2/2017 | White et al. |
| 2017/0367433 | A1 | 12/2017 | Frett |
| 2018/0221915 | A1 | 8/2018 | Simor et al. |
| 2018/0275928 | A1 | 9/2018 | Boksteyn |
| 2018/0289095 | A1 | 10/2018 | Catterson et al. |
| 2019/0104797 | A1 | 4/2019 | Teetzel et al. |
| 2019/0191808 | A1 | 6/2019 | Becker et al. |
| 2019/0269193 | A1* | 9/2019 | Benyola ..... A42B 3/044 |
| 2019/0320753 | A1 | 10/2019 | Le et al. |
| 2019/0380417 | A1 | 12/2019 | Zhavoronkov et al. |
| 2019/0387829 | A1 | 12/2019 | Becker et al. |
| 2020/0015537 | A1 | 1/2020 | Becker et al. |
| 2020/0037693 | A1 | 2/2020 | Klimek et al. |
| 2020/0305532 | A1 | 10/2020 | Lange et al. |

FOREIGN PATENT DOCUMENTS

| | | | |
|---|---|---|---|
| CN | 201319192 | Y | 9/2009 |
| CN | 102791157 | A | 11/2012 |
| CN | 104871384 | A | 8/2015 |
| CN | 204949670 | U | 1/2016 |
| CN | 205106513 | U | 3/2016 |
| CN | 206043574 | U | 3/2017 |
| CN | 106659261 | A | 5/2017 |
| CN | 206312966 | U | 7/2017 |
| DE | 3042159 | A1 | 6/1982 |
| DE | 8226935 | U1 | 2/1983 |
| DE | 29519601 | U1 | 2/1996 |
| DE | 29906107 | U1 | 7/1999 |
| DE | 29914563 | U1 | 1/2000 |
| DE | 102005038893 | A1 | 3/2006 |
| DE | 202011051831 | U1 | 11/2011 |
| DE | 102015216835 | A1 | 3/2017 |
| DE | 102016115889 | A1 | 3/2018 |
| EP | 0412205 | A1 | 2/1991 |
| EP | 1393643 | A1 | 3/2004 |
| EP | 2183989 | A1 | 5/2010 |

(56) References Cited

FOREIGN PATENT DOCUMENTS

| | | | |
|---|---|---|---|
| FR | 2335169 | A1 | 7/1977 |
| FR | 2668901 | A1 | 5/1992 |
| GB | 826012 | A | 12/1959 |
| GB | 974901 | A | 11/1964 |
| GB | 2059206 | A | 4/1981 |
| GB | 2254528 | A | 10/1992 |
| JP | S6468507 | A | 3/1989 |
| JP | 2000328342 | A | 11/2000 |
| JP | 2005060889 | A | 3/2005 |
| JP | 2011-002958 | A | 1/2011 |
| KR | 20010011095 | A | 2/2001 |
| KR | 101530061 | B1 | 6/2015 |
| WO | 2004032658 | A1 | 4/2004 |
| WO | 2011129576 | A2 | 10/2011 |
| WO | 2012006653 | A1 | 1/2012 |
| WO | 2012017836 | A1 | 2/2012 |
| WO | 2012148519 | A1 | 11/2012 |
| WO | 2016001915 | A1 | 1/2016 |
| WO | 2016022984 | A1 | 2/2016 |
| WO | 2018/043025 | A1 | 3/2018 |

OTHER PUBLICATIONS

International Search Report for Application No. PCT/EP2019/063825, dated Jul. 4, 2019, 3 pages.

Rajpurohit, A. "Fiber Reinforced Composites: Advances in Manufacturing Techniques.", Researchgate; https://www.researchgate.net/publication/279885386. (Year: 2014).

D'Hooghe et al., Thermoplastic Composite Technology; Tougher Than You Think. Adv Mat. 2000;12(23):1865-1868.

* cited by examiner

PROTECTIVE HELMET

CROSS-REFERENCE TO RELATED APPLICATIONS

This application is a national stage application of international application no. PCT/EP2019/063825 filed May 28, 2019, entitled "Protective Helmet," claiming priority under 35 U.S.C. § 119(a)-(d) to German application no. DE 10 2018 004 314.3 filed May 30, 2018, which are hereby expressly incorporated by reference as part of the present disclosure.

FIELD OF THE INVENTION

The present disclosure relates to a protective helmet, such as a motorcycle protective helmet.

BACKGROUND

In the field of passenger cars, head-up displays are increasingly being used as display systems. These make it possible to project different information about the operating state of the vehicle or else also graphics, such as arrows, bars or the like, as direction or route data for a navigation application, into the viewing field of the driver. In this manner, not only can route information be overlaid on the environment, which facilitates the assignment of route information to the possible routes in the environment, rather it is also made possible for the driver of the vehicle to detect much other information without changing their field of view, that is to say without turning their viewing direction away from the environment, for example downwards.

Recently, head-up displays have also been developed for motorcycle riders. In this case, the requirements for placing the corresponding devices are obviously very different from in the case of a passenger car.

A protective helmet with a display device constructed as a head-up display is known from the prior art and specifically from US 2015/0338659 A1. In this case, this display device may, in a first variant, be fastened externally on the protective helmet in the region of the viewing opening, so that the optical module with the projection surface for projecting an image can be arranged outside the visor, in the region of the viewing opening. In a second variant, a mount, in which the display device can be arranged, is provided inside the protective helmet in the chin shell region. The projection surface is then in front of the visor with respect to the person wearing the protective helmet, so that the person wearing the protective helmet does not have to see through the visor onto the projection surface. The arrangement in the protective helmet also makes it possible to retain the external shape of the protective helmet substantially.

However, it is disadvantageous for this arrangement inside the protective helmet, that the mount must be dimensioned very large due to the size of the display device, which leads to massive limitations for the configuration of the chin shell region in view of the small installation space available. Also, particularly large risks of injury result from this due to the display device in the event of a crash. Additionally, the user of a head-up display regularly has a dominant eye, in front of which the projection surface is advantageously arranged. In the case of the variant with external engagement, this circumstance can easily be taken into account in that the display device is fastened interchangeably on the protective helmet on the left or the right side. For arrangement inside the protective helmet, a mechanism would have to be used, which allows pivoting of the projection surface from left to right, which mechanism would be complex and probably involve a risk of injury.

SUMMARY

It is an object of the inventors to provide an improved protective helmet in such a manner that a display device can be arranged inside the protective helmet more easily and that there exists the option for the person wearing the protective helmet to select the dominant eye for positioning the projection surface of the display device.

This object may be achieved, for example, by means of a protective helmet with features discussed in the present disclosure.

In at least some embodiments, two separate, but substantially identically dimensioned slots are provided in each case inside the protective helmet for a part of the display device. This division of the mount into two slots, which is also associated with a division of the display device into two parts, not only makes it possible to dimension each individual slot smaller than a single slot for the entire display device, which significantly mitigates the spatial problem inside the protective helmet, but furthermore also to interchange the occupancy of the two slots by the two parts of the display device, as a result of which an optional arrangement of the projection surface in front of the left or the right eye of the person wearing the protective helmet can be achieved. Thus, both problems are solved simultaneously.

The disclosed protective helmet, which may be a motorcycle protective helmet in particular, has an outer shell for distributing impact forces, wherein the outer shell has a chin shell region for covering a chin part of a person wearing the protective helmet. This chin shell may incidentally be constructed in one piece with the outer shell. Likewise, the chin shell region may in particular be pivotable, specifically with respect to the outer shell incidentally, by means of a pivoting mechanism of the protective helmet.

In at least some embodiments, the outer shell forms a viewing opening arranged above the chin shell region for the person wearing the protective helmet to see through. The protective helmet may have an in particular pivotable visor for covering the viewing opening.

In at least some embodiments, the protective helmet further has a slot with a slot shape for formfittingly accommodating an electronic module corresponding to the slot shape. The term slot shape designates the shape of the slot for the formfitting accommodation. The electronic module may be accommodated wholly or partially by the slot, wherein an overwhelming part of the electronic module is accommodated by the slot.

In at least some embodiments, the slot has a slot opening substantially bordering an edge of the viewing opening. This slot opening may be used for inserting the electronic module and alternatively or additionally for guiding out a part of the accommodated electronic module or allowing a part of the accommodated electronic module to protrude.

In at least some embodiments, the protective helmet is characterized in that the protective helmet has a further slot with a further slot opening substantially bordering the edge of the viewing opening and with the slot shape thereof for formfittingly accommodating a further electronic module corresponding to the slot shape. The further slot may have a slot shape which is identical to the slot shape of the slot. In this manner, an alternate mounting of the electronic module and the further electronic module in the slot and the further slot is enabled. The further electronic module may be accommodated wholly or partially by the further slot, wherein an overwhelming part of the further electronic module is accommodated by the further slot in at least some embodiments.

It may be that the protective helmet comprises none or only one of the electronic module and the further electronic module. In at least some embodiments, the protective helmet comprises the electronic module and the further electronic module, wherein, in particular embodiments, the electronic module can be accommodated by the slot and the further electronic module can be accommodated by the further slot. In particular embodiments, the slot and the further slot are set up for mutually interchangeable accommodation of the electronic module and the further electronic module. Furthermore, in particular embodiments, the slot is set up for the detachable accommodation of the electronic module and the further slot is set up for the detachable accommodation of the further electronic module.

In at least some embodiments, the electronic module and the further electronic module are comprised in an electronic system for displaying information in an image for the person wearing the protective helmet. This electronic system may be a head-up display in particular embodiments. The electronic module may comprise an optical module for depicting the image. Likewise, it may be that the further electronic module comprises a processor module with a processor device (example shown in the Figures by reference number 21) for processing the information for the image. In other words, the processor device carries out a preparatory image processing for depicting the image by means of the optical module, wherein the information processed by the processor device is provided to the optical module.

In at least some embodiments, the optical module comprises a projection surface for projecting the image. The optical module may have an imaging device (example shown in the Figures by reference number 18) for generating the image and a collimator (example shown in the Figures by reference number 19) for aligning light rays of the generated image for projection onto the projection surface. The imaging device may be a microdisplay. The projection surface may be a partially reflective and see-through mirror.

The optical module may have any desired number of housings and in particular embodiments has only one housing. In at least some embodiments, though, the optical module has a main housing (example shown in the Figures by reference number 14), a display housing (example shown in the Figures by reference number 15) and a joint (example shown in the Figures by reference number 16) for pivoting the display housing with respect to the main housing. Then, the optical module consists of at least two parts, which can be pivoted relatively to one another. This may be any desired type of joint currently known or later developed. The division of the functionality between the main housing and the display housing can be arbitrary. In at least some embodiments, the projection surface is accommodated in the display housing. Pivoting the display housing allows the person wearing the protective helmet a setting of the position and/or alignment of the projection surface, which is suitable for them. For pivotability, at least one of the two housings should not be formfittingly accommodated by the slot. Therefore, it may be that in the case of the accommodation of the electronic module by the slot, the main housing is formfittingly accommodated by the slot and the display housing can be pivoted.

A line arrangement, which, if appropriate, may be arranged subsequently, may be provided for a signaling connection between the electronic module and the further electronic module. In at least some embodiments, the protective helmet has a line arrangement for signaling connection of the electronic module accommodated by the slot to the further electronic module accommodated by the further slot. This line arrangement can be securely connected to the outer shell. This connection to the outer shell may exist directly indirectly.

In at least some embodiments, the line arrangement has a contact arrangement (example shown in the Figures by reference number 20*a*) securely connected to the slot for electrically contacting the electronic module accommodated by the slot and a further contact arrangement (example shown in the Figures by reference number 20*b*) securely connected to the further slot for electrically contacting the further electronic module accommodated by the further slot. Thus, a reliable connection can even be ensured by the locating of the electronic module or the further electronic module in the slot or in the further slot. Here, the contact arrangement, the further contact arrangement and the line arrangement may be set up to produce an identical signaling connection between the electronic module and the further electronic module when the electronic module is mounted in the slot and the further electronic module is mounted in the further slot and also when the further electronic module is mounted in the slot and the electronic module is mounted in the further slot. In this manner, the electronic module and the further electronic module are correctly connected to one another independently of their respective mounting in the slot or in the further slot.

In at least some embodiments, the slot and the further slot are arranged internally to the outer shell in each case. In this arrangement, the accommodated electronic module and the accommodated further electronic module may be arranged internally to the outer shell.

In addition to the outer shell, the protective helmet may have further layers for mechanically protecting the person wearing the protective helmet. In at least some embodiments, the protective helmet has an inner layer, accommodated by the outer shell, for absorbing impact forces. The slot and the further slot may be arranged between the outer shell and the inner layer. The electronic module accommodated by the slot and the further electronic module accommodated by the further slot may be arranged between the outer shell and the inner layer.

The position and alignment of the slot with respect to the further slot may be arbitrary. In at least some embodiments, the slot and the further slot are arranged substantially symmetrically to a central plane of the protective helmet, which central plane is aligned parallel to a direction of sight of the person wearing the protective helmet and parallel to a vertical direction of the person wearing the protective helmet. Such a placement of the slot and the further slot enables a uniform and therefore balanced weight distribution on the protective helmet. In addition to the position of the slot and the further slot, the alignment thereof may also be selected. This may be done so that the slot shape predetermines a respective alignment of the accommodated electronic module and the accommodated further electronic module. Thus, the slot shape(s) may be designed to block a rotation of the accommodated electronic module and/or the accommodated further electronic module. Here, a respective alignment of the slot shape of the slot and the further slot may be substantially symmetrical to the central plane of the protective helmet. From the point of view of the person wearing the protective helmet, the alignment of the slot shape of the slot and the further slot is therefore identical in such embodiments.

The slot and/or the further slot may also be arranged above the viewing opening. In at least some embodiments, the slot and the further slot are arranged at the chin shell region. They are therefore arranged below the viewing opening. Here, with respect to the central plane, the slot and the further slot span an angle which is between 45° and 125° in some embodiments, and in some such embodiments, between 60° and 90°.

Fixing of the electronic module and the further electronic module in the slot or in the further slot can take place in any desired manner. In at least some embodiments, the slot and the further slot in each case have a gripping device, which in some embodiments is a releasable snap connection to the electronic module and the further electronic module. The respective gripping device may have a snapping projection (examples shown in the Figures by reference numbers 22*a*, 22*b*, 23*a*, 23*b*) and/or a snap recess. The snap recess may be set up to produce the snap connection by engagement with a projection of the electronic module or the further electronic module. The snap projection may be set up to produce the snap connection by engagement with a recess of the electronic module or the further electronic module.

In at least some embodiments, the outer shell has a helmet terminal edge for lower delimiting of the protective helmet and in that the slot and the further slot are arranged bordering the helmet terminal edge in each case. In this manner, the electronic module and the further electronic module can be inserted into the slot and into the further slot without the protective helmet having to be taken off. To this end, the slot may have an insertion opening bordering the helmet terminal edge for inserting the electronic module and the further slot may have a further insertion opening bordering the helmet terminal edge for inserting the further electronic module. The arrangement of the slot and the further slot may be such so that the accommodated electronic module and the accommodated further electronic module are arranged bordering the helmet terminal edge.

The protective helmet may also have further slots. In at least some embodiments, the protective helmet has at least one additional slot for formfittingly accommodating a respective additional module. These additional slots may, in principle, be arranged as desired on the protective helmet. The at least one additional slot may be arranged in a rear region of the outer shell, e.g., substantially opposite the viewing opening. In this manner, the weight of the at least one accommodated additional module may at least partially balance the weight of the electronic module and the further electronic module. Furthermore, it may be that the at least one additional slot is arranged bordering the helmet terminal edge.

In at least some embodiments, the protective helmet has two additional slots. The two additional slots may be arranged substantially symmetrically to the central plane of the protective helmet. This ensures a substantially uniform weight distribution on the protective helmet. In particular, it may be that the two additional slots each have a mount opening bordering the helmet terminal edge for inserting the respective additional module.

The at least one additional module may have any desired function. In at least some embodiments, the at least one additional module has a battery (example shown in the Figures by reference number 17) for operationally supplying the electronic module and/or the further electronic module with electrical energy.

In at least some embodiments, the protective helmet has a microphone arrangement and/or loudspeaker arrangement arranged internally to the outer shell in each case, wherein the line arrangement may be set up to connect the microphone arrangement and/or the loudspeaker arrangement to the electronic module accommodated by the slot and/or to the further electronic module accommodated by the further slot in a signaling manner.

In at least some embodiments, the protective helmet has a ventilation duct arrangement connected to the slot and the further slot for cooling the electronic module and the further electronic module. In at least some embodiments, the outer shell has at least one vent (example shown in the Figures by reference number 24) for supplying outside air to the ventilation duct arrangement. In particular embodiments, it may be that the at least one vent is set up for supplying outside air to the person wearing the protective helmet.

This summary is not exhaustive of the scope of the present aspects and embodiments. Thus, while certain aspects and embodiments have been presented and/or outlined in this summary, it should be understood that the present aspects and embodiments are not limited to the aspects and embodiments in this summary. Indeed, other aspects and embodiments, which may be similar to and/or different from, the aspects and embodiments presented in this summary, will be apparent from the description, illustrations, and/or claims, which follow.

It should also be understood that any aspects and embodiments that are described in this summary and do not appear in the claims that follow are preserved for later presentation in this application or in one or more continuation patent applications.

BRIEF DESCRIPTION OF THE DRAWINGS

Further configurations result from the following description with reference to the figures. In the drawings, depicting only one exemplary embodiment, the drawings show.

DETAILED DESCRIPTION

Figure 1:
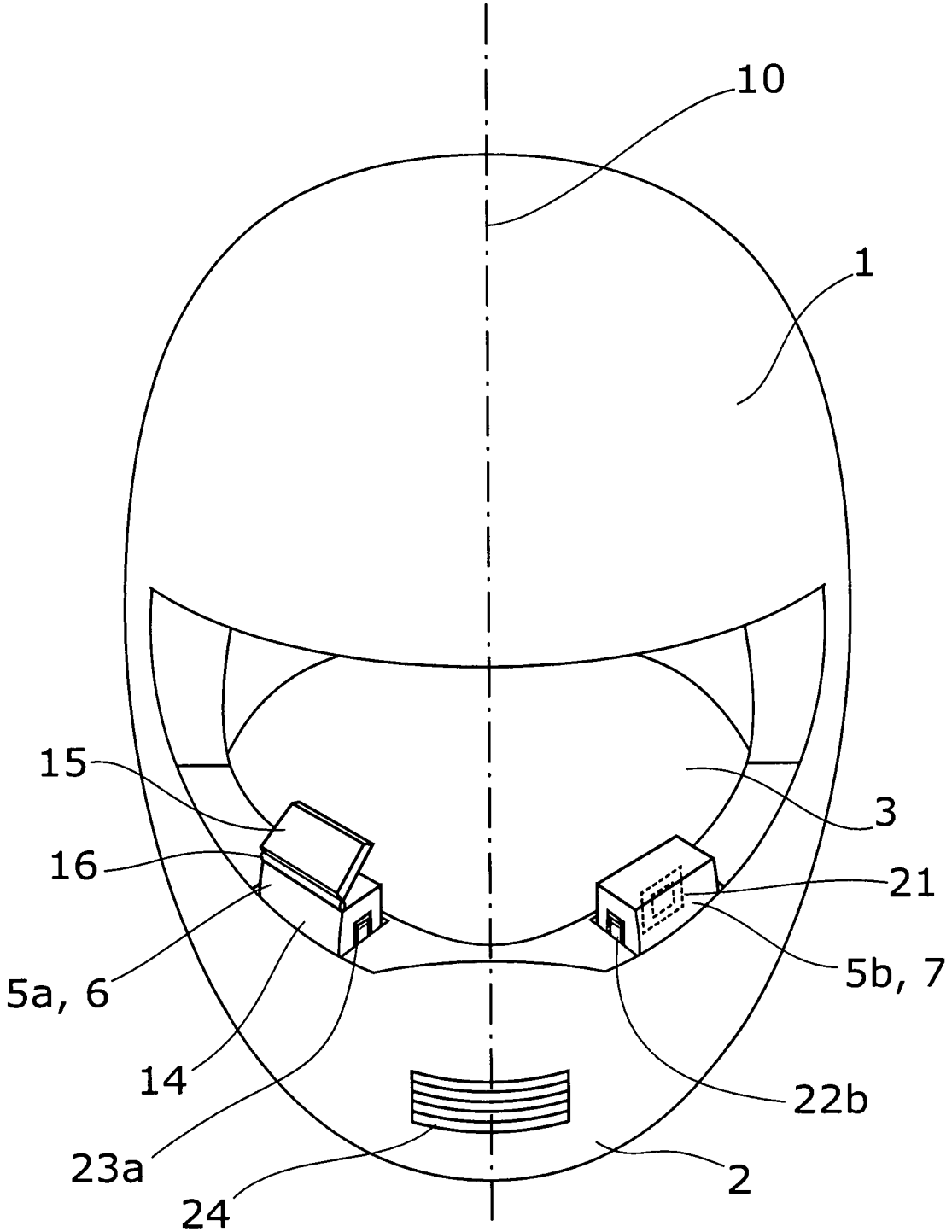
FIG. 1 shows a schematic oblique front view of an exemplary embodiment of a protective helmet.

The exemplary protective helmet illustrated in FIG. 1 is a motorcycle protective helmet and specifically a full-face helmet. It has an outer shell 1, labelled in FIGS. 1 and 3, for distributing impact forces. In the exemplary embodiment illustrated, the outer shell 1 consists of glass fiber with an added special resin. A chin shell region 2 of the outer shell 1 covers the chin part of a person wearing the protective helmet, who is not illustrated here. A viewing opening 3 is above the chin shell region 2, which viewing opening can be covered by a visor of the protective helmet, which is not illustrated here. The chin shell region 2 is constructed in one piece with the remainder of the outer shell 1.

Figure 2:
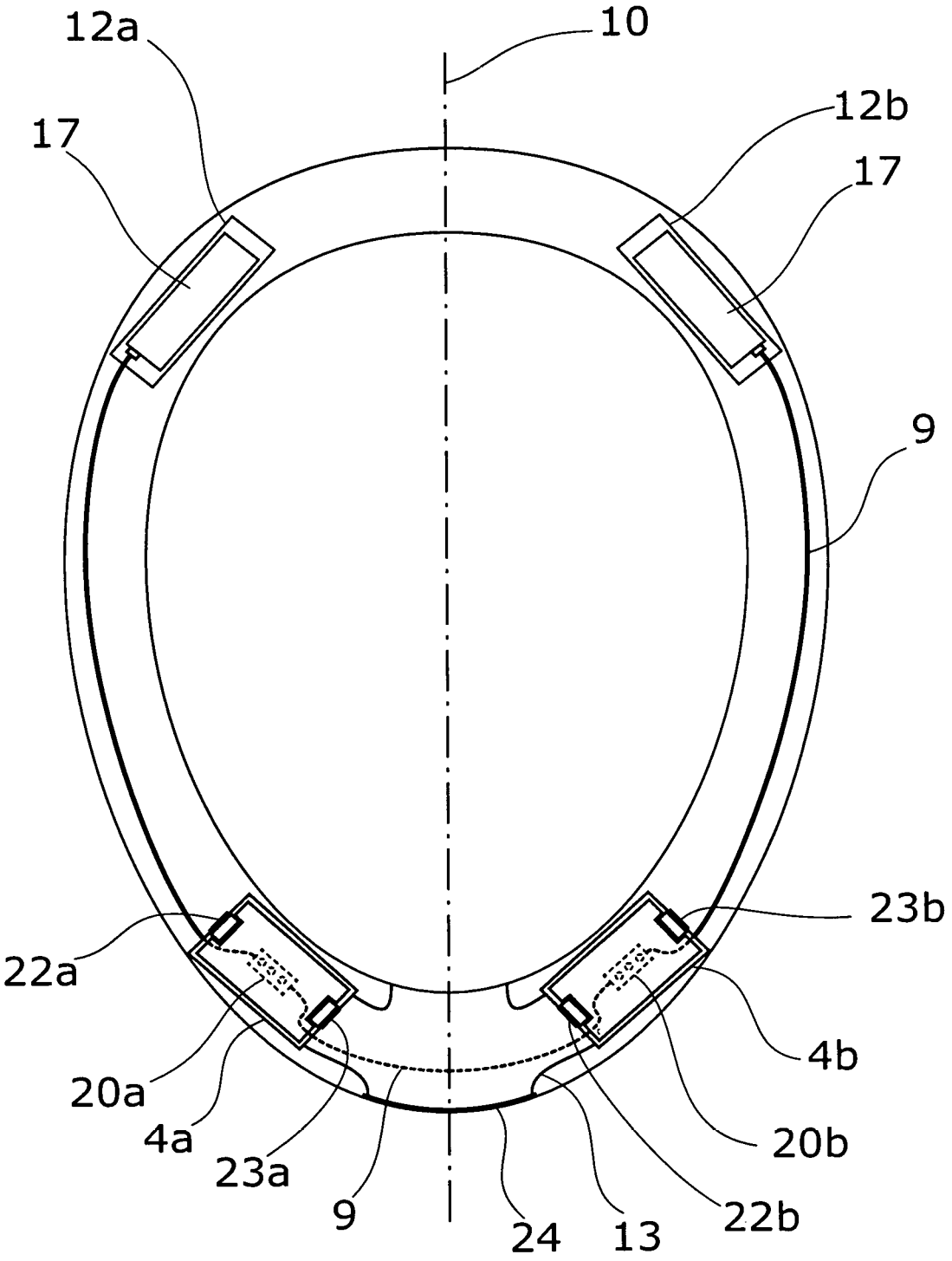
FIG. 2 shows a schematic section plan view of the protective helmet of FIG. 1.

The protective helmet shown in the figures has a slot 4*a* with a slot opening, and a further slot 4*b* with a further slot opening, wherein the slot shape common to both slots 4*a, b* can be seen from FIG. 2. In FIG. 1, the protective helmet is illustrated with an electronic module 5*a* accommodated by the slot 4*a* and a further electronic module 5*b* accommodated by the further slot 4*b*. The electronic module 5*a* is the optical module 6 of a head-up display and the further electronic module 5*b* is the processor module 7 of the head-up display. The projection surface 8 of the optical module 6 is illustrated schematically in FIG. 3.

In the illustrated embodiment, the slot 4*a* and the further slot 4*b* are symmetrical with regards to position and alignment to a central plane 10 of the protective helmet indicated in FIGS. 1 and 2. It can be seen that the slot 4*a* and the further slot 4*b* border the helmet terminal edge 11 of the outer shell 1 for delimiting the protective helmet and in particular the outer shell 1 at the bottom.

In addition to the slot 4*a* and the further slot 4*b*, the illustrated protective helmet further has two additional slots 12*a, b*, which are set up for accommodating a respective additional module, wherein one of the additional modules is a battery here. Also, the additional slots 12*a, b* in the illustrated embodiment are arranged symmetrically with respect to the central plane 10.

Figure 3:
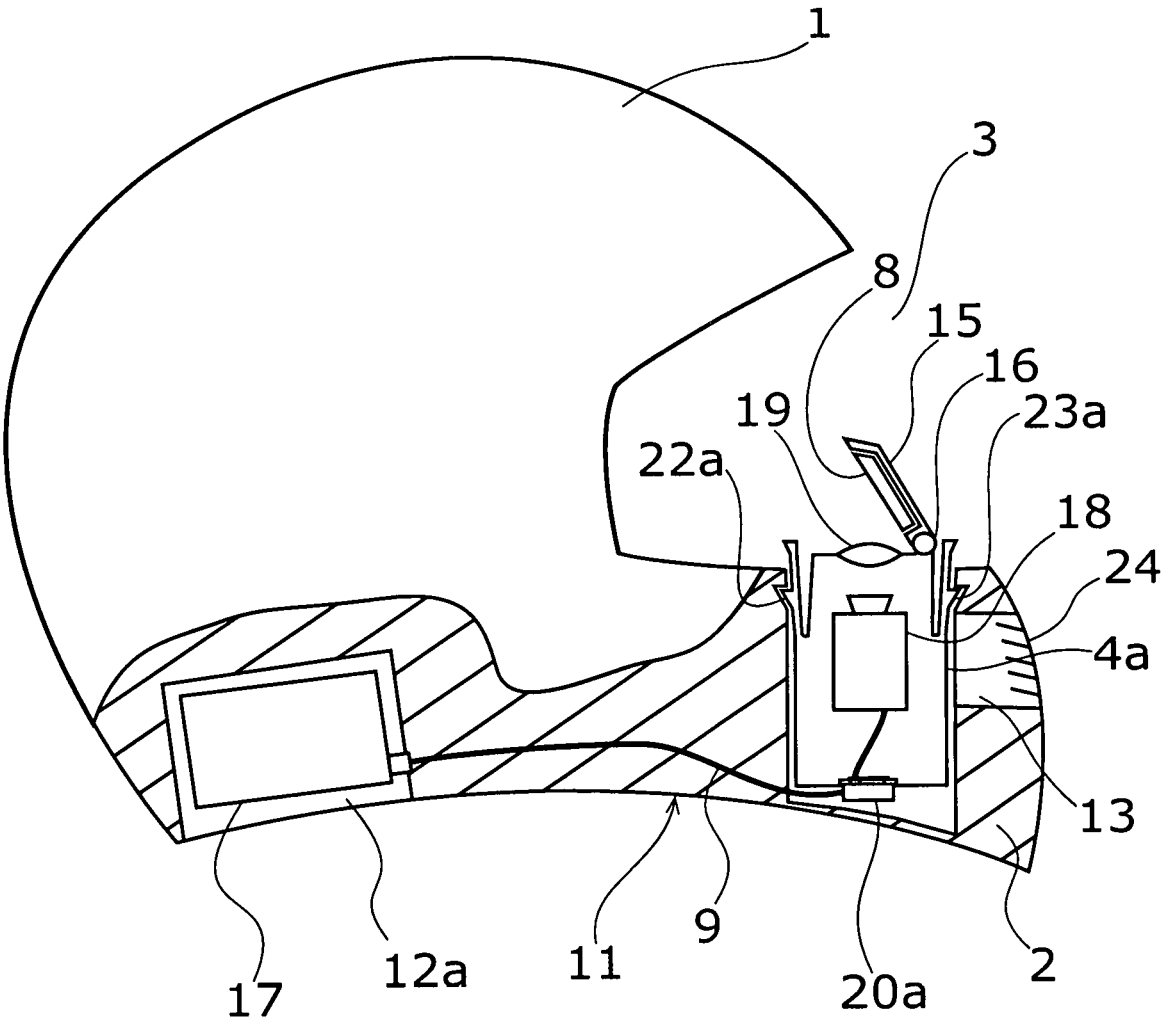
FIG. 3 shows a schematic side view of the protective helmet of FIG. 1.

A line arrangement 9 for electrically connecting the electronic module 5*a* to the further electronic module 5*b* and to the additional modules in the additional slots 12*a, b* is illustrated schematically in FIGS. 2 and 3. A ventilation duct arrangement 13 for supplying air for cooling the electronic module 5*a* and the further electronic module 5*b* is shown schematically in FIG. 2.

While the above describes certain embodiments, those skilled in the art should understand that the foregoing description is not intended to limit the spirit or scope of the present disclosure. It should also be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure.

The invention claimed is:

1. A protective helmet comprising an outer shell configured to distribute impact forces thereon, the outer shell defining a chin shell portion configured to cover a chin part of a user wearing the protective helmet, a viewing opening located above the chin shell portion configured for a user wearing the protective helmet to see through the viewing opening, a slot defining a slot shape configured to form-fittingly receive an electronic module corresponding to the slot shape and a slot opening substantially adjacent an edge of the viewing opening, and a further slot defining a further slot opening substantially adjacent the edge of the viewing opening and a further slot shape configured to form-fittingly receive a further electronic module corresponding to the further slot shape, wherein the slot and the further slot are located in the chin shell portion;

wherein the protective helmet includes a line configured to provide a signal connection between an electronic module and a further electronic module when received in the slot and further slot, respectively; and wherein the line includes a contact securely connected to the slot and configured to contact an electronic module when an electronic module is received in the slot, and a further contact securely connected to the further slot configured to electrically contact a further electronic module when a further electronic module is received by the further slot.

2. The protective helmet according to claim 1, further comprising an electronic system configured to display information in an image to a user wearing the protective helmet, wherein the electronic system includes the electronic module and the further electronic module.

3. The protective helmet according to claim 2, wherein the electronic system further comprises an optical module configured to depict said image.

4. The protective helmet according to claim 3, wherein the optical module comprises a projection surface configured to project the image.

5. The protective helmet according to claim 4, wherein the optical module defines a main housing, a display housing and a joint configured to allow pivoting of the display housing relative to the main housing.

6. The protective helmet according to claim 5, wherein the projection surface is located in the display housing.

7. The protective helmet according to claim 6, wherein, when an electronic module is received in the slot, the main housing is form-fittingly received by the slot and the display housing is pivotable via the joint.

8. The protective helmet according to claim 4, wherein the optical module includes an imaging device configured to generate the image and a collimator configured to align light rays of the generated image for projection of the image onto the projection surface.

9. The protective helmet according to claim 1, wherein the slot and the further slot are each located internally to the outer shell.

10. The protective helmet according to one claim 1, wherein the protective helmet includes an inner layer located within the outer shell and configured to absorb impact forces thereon.

11. The protective helmet according to claim 1, wherein the slot and the further slot are located substantially symmetrically relative to a central plane of the protective helmet, wherein the central plane is aligned parallel with a direction of sight of a user wearing the protective helmet and parallel to a vertical direction of a user wearing the protective helmet.

12. The protective helmet according to claim 1, wherein the slot and the further slot each include a grip configured to grip the electronic module and the further electronic module, respectively.

13. The protective helmet according to claim 1, wherein the outer shell defines a helmet terminal edge delimiting a lower edge of the protective helmet, wherein the slot and the further slot are located adjacent the helmet terminal edge.

14. The protective helmet according to claim 1, wherein the protective helmet defines at least one additional slot configured to form-fittingly receive an additional module.

15. The protective helmet according to claim 14, wherein the at least one additional slot includes two additional slots.

16. The protective helmet according to claim 14, wherein the at least one additional module includes a battery configured to operationally supply the electronic module and/or the further electronic module with electrical energy.

17. The protective helmet according to one claim 1, wherein the protective helmet includes ventilation ducting connected to the slot and the further slot and configured to cool the electronic module and the further electronic module.

18. A protective helmet comprising an outer shell configured to distribute impact forces thereon, the outer shell defining a chin shell portion configured to cover a chin part of a user wearing the protective helmet, a viewing opening located above the chin shell portion configured for a user wearing the protective helmet to see through the viewing opening, a slot defining a slot shape configured to form-fittingly receive an electronic module corresponding to the slot shape and a slot opening substantially adjacent an edge of the viewing opening, a further slot defining a further slot opening substantially adjacent the edge of the viewing opening and a further slot shape configured to form-fittingly receive a further electronic module corresponding to the further slot shape, and a line configured to provide a signal connection between an electronic module and a further electronic module when received in the slot and further slot, respectively, wherein the line includes a contact securely connected to the slot and configured to contact an electronic module when an electronic module is received in the slot, and a further contact securely connected to the further slot configured to electrically contact a further electronic module when a further electronic module is received by the further slot.

19. A protective helmet comprising an outer shell configured to distribute impact forces thereon, the outer shell defining a chin shell portion configured to cover a chin part of a user wearing the protective helmet, a viewing opening located above the chin shell portion configured for a user wearing the protective helmet to see through the viewing opening, a slot defining a slot shape configured to form-fittingly receive an electronic module corresponding to the slot shape and a slot opening substantially adjacent an edge of the viewing opening, a further slot defining a further slot opening substantially adjacent the edge of the viewing opening and a further slot shape configured to form-fittingly receive a further electronic module corresponding to the further slot shape, and at least one additional slot configured to form-fittingly receive an additional module;

wherein the protective helmet includes a line configured to provide a signal connection between an electronic module and a further electronic module when received in the slot and further slot, respectively; and wherein the line includes a contact securely connected to the slot and configured to contact an electronic module when an electronic module is received in the slot, and a further contact securely connected to the further slot configured to electrically contact a further electronic module when a further electronic module is received by the further slot.

20. The protective helmet according to claim 19, wherein the at least one additional slot includes two additional slots.

21. The protective helmet according to claim 19, wherein the at least one additional module includes a battery configured to operationally supply the electronic module and/or the further electronic module with electrical energy.

22. A protective helmet comprising an outer shell configured to distribute impact forces thereon, the outer shell defining a chin shell portion configured to cover a chin part of a user wearing the protective helmet, a viewing opening located above the chin shell portion configured for a user wearing the protective helmet to see through the viewing opening, a slot defining a slot shape configured to form-fittingly receive an electronic module corresponding to the slot shape and a slot opening substantially adjacent an edge of the viewing opening, a further slot defining a further slot opening substantially adjacent the edge of the viewing opening and a further slot shape configured to form-fittingly receive a further electronic module corresponding to the further slot shape, and ventilation ducting connected to the slot and the further slot and configured to cool the electronic module and the further electronic module;

wherein the protective helmet includes a line configured to provide a signal connection between an electronic module and a further electronic module when received in the slot and further slot, respectively; and wherein the line includes a contact securely connected to the slot and configured to contact an electronic module when an electronic module is received in the slot, and a further contact securely connected to the further slot configured to electrically contact a further electronic module when a further electronic module is received by the further slot.

* * * * *